US005249887A

United States Patent [19]

Phillips

[11] Patent Number: 5,249,887

[45] Date of Patent: Oct. 5, 1993

[54] APPARATUS FOR CONTROL OF LIQUIDS

[75] Inventor: Donald I. Phillips, Hawthorn, Australia

[73] Assignee: Swinburne Limited, Australia

[21] Appl. No.: 781,810

[22] Filed: Oct. 23, 1991

[30] Foreign Application Priority Data

Oct. 1, 1991 [AU] Australia ..... 84863/91

[51] Int. Cl.[5] ..... E02B 11/00

[52] U.S. Cl. ..... 405/36; 405/53; 210/170; 210/252

[58] Field of Search ..... 405/36, 52, 53, 55, 405/74; 210/170, 248, 252, 320, 521

[56] References Cited

U.S. PATENT DOCUMENTS

| | | | |
|---|---|---|---|
| 2,754,179 | 7/1956 | Whatley | 210/252 X |
| 3,460,677 | 8/1969 | Fifer | 210/521 X |
| 3,510,001 | 5/1970 | Baer et al. | 210/252 X |
| 3,904,524 | 9/1975 | Pelton et al. | 405/55 X |
| 3,951,817 | 4/1976 | Snyder | 210/521 |
| 4,224,156 | 9/1980 | Pardikes et al. | 405/74 X |
| 4,251,486 | 2/1981 | Sohda | 210/252 X |
| 4,377,477 | 3/1983 | Dunkers | 210/170 |
| 4,876,004 | 10/1989 | Verhoeff | 210/170 |
| 4,892,651 | 1/1990 | Hill | 210/170 X |

FOREIGN PATENT DOCUMENTS

| | | | |
|---|---|---|---|
| 165513 | 10/1982 | Japan | 405/52 |
| 1182112 | 9/1985 | U.S.S.R. | 405/74 |
| 1497350 | 7/1989 | U.S.S.R. | 405/52 |

*Primary Examiner*—Dennis L. Taylor
*Assistant Examiner*—John Ricci
*Attorney, Agent, or Firm*—Andrus, Sceales, Starke & Sawall

[57] ABSTRACT

Apparatus for controlling liquid from a site comprising at least three liquid retention cells which are arranged in series with respect to the flow path of the liquid through the apparatus, the liquid retention cells being arranged in at least one group which comprises at least three of said cells disposed adjacent one another, an inlet for delivering liquid to an upstream cell of the apparatus and an outlet for discharging liquid from a downstream cell of the apparatus to a discharge line, and transfer orifices which provide liquid communication between adjacent cells in the group, the or each transfer orifice being configured so as to control the liquid flow between adjacent cells and create a condition whereby there is a dissipation of energy of the liquid between each cell apparatus.

18 Claims, 3 Drawing Sheets

A
A
1
2
3
4
5
6
10
12
14
16
22
23
24
26
27
28
30
31
40
42
43
45

100
101
102
103
104
105
106
110
112
114
116
122
123
124
125
126
127
128
129
130
131
140
142
143
150
160
165

APPARATUS FOR CONTROL OF LIQUIDS

This invention relates to apparatus for control of liquids.

In a particular application, this invention relates generally to stormwater discharge regulation and control and more particularly but not exclusively to the control of stormwater drain-off in urban or suburban environments such as building sites and the like.

The redevelopment of urban building sites for the purpose of introducing multiple dwellings on pre-existing single dwelling sites have led to some significant problems in the control of stormwater drain-off from the site. Many redeveloped urban sites are regulated by an appropriate authority by what is known as a permissible site discharge which relates to the permissible outflow of stormwater from the site to the main off-site drain. The problems associated with such site redevelopment have been discussed in applicant's co-pending Australian patent application 72447/87. The invention which is the subject of that aforementioned patent application provides one solution to the problem of control of stormwater drain-off.

The present invention should not, however, be considered as confined to the control of stormwater but has wider application in dealing with liquids in general.

For instance, the present invention may be applied to waste liquids or liquids containing wastes or to liquids containing valuable or recoverable materials.

Inter alia, the present invention may be applied to sewage treatment plants, straining and mixing pits, silt pits, grease interceptors, separator pits, neutralising pits, settling pits, effluent control systems, petrol interceptor pits, oil interceptor pits, chemical and material waste interceptor pits and in general for separation of a liquid from another material or for controlled discharge of a liquid.

According to the present invention there is provided apparatus for controlling liquid from a site comprising at least three liquid retention cells which are arranged in series with respect to the flow path of the liquid through the apparatus, the liquid retention cells being arranged in at least one group which comprises at least three of said cells disposed adjacent one another, an inlet for delivering liquid to an upstream cell of the apparatus and an outlet for discharging liquid from a downstream cell of the apparatus to a discharge line, and transfer orifices which provide liquid communication between adjacent cells in the group, the or each transfer orifice being configured so as to control the liquid flow between adjacent cells and create a condition whereby there is a dissipation of energy of the liquid between each cell apparatus.

When in operation the delivery line may be operatively connected to an on-site storage zone and the discharge line may be operatively connected to a discharge drain. The storage zone may be arranged to collect liquid such as stormwater from the site such as via the dwelling gutters. The arrangement is such that the pressure head of liquid collected on the site is converted to kinetic energy in several stages through the liquid retention cells, the kinetic energy being dissipated by friction and turbulence created within the transfer orifice and/or within the liquid retention cells. It will be appreciated that it is possible thereby to regulate the discharge by varying the number of cells and size of transfer orifices.

Preferably the apparatus has its inlet operatively connected to an on-site storage zone. An upstream cell may in some cases be part of said on-site storage zone. The inlet may in one form be operatively connected to the on-site storage zone by a delivery line. The delivery line may be angularly inclined with respect to the inlet to the apparatus.

The on-site storage zone may take any suitable form and for example may include a series of pits or storage pipes in liquid communication with the inlet to the apparatus via the delivery line. As mentioned earlier, the outlet from the apparatus may be in liquid communication with a discharge drain via the discharge line.

The apparatus may be in the form of a free surface system or a pressurised system the latter being capable of operating at a higher pressure head and therefore capable of handling larger flows. Many of the features of the apparatus as described below in to referring various preferred forms are common to both systems although there are certain differences and these will be indicated where necessary.

Preferably the or each transfer orifice is disposed at or towards a lower portion of the cells.

Furthermore the transfer orifices may be dimensioned so as to permit debris, waste or recoverable material to pass from one cell to the adjacent cell while at the same time causing the energy dissipation. Advantageously the orifices have a length dimension greater than the height dimension thereof; that is for example, they may be generally rectangular in shape.

The apparatus when in the form of a free surface system may further include an overflow weir between adjacent cells which permits the flow of liquid over that weir in case the transfer orifice becomes blocked or the flow of liquid exceeds a predetermined limit.

In the apparatus of the pressurised system type overflow weirs are generally not provided between adjacent cells. This permits selected cells to be completely filled with liquid and operate under higher pressure head. In this particular type of system, vents may be provided for permitting the escape of air or gas from a cell as it fills with liquid.

The number of cells and the arrangement relative to one another can be varied in any suitable manner. For example, the cells may be arranged in a linear configuration one behind the other. Where three or more cells are provided in a group and each cell is disposed one behind the other, it is preferable that the transfer orifices between adjacent cells are off-set from one another with respect to the linear direction so that liquid entering a cell does not pass directly to the next cell and it is believed that this causes the flow to be deflected into a rotary motion so as to further dissipate the liquid pressure head before passing through to the next one. It will be appreciated, however, that the transfer orifices may be disposed opposite one another.

Furthermore, the apparatus may include more than one group of cells and these may be arranged in any suitable arrangement to suit the particular site upon which the apparatus is located.

The delivery line may be angularly inclined with respect to the inlet to the apparatus. This may be for the purpose of compensating for installations where the delivery line must be off-set in relation to the inlet to the apparatus and as a result can create more turbulence in the immediate upstream cell so as to thereby dissipate the kinetic energy more easily.

The transfer orifices are arranged so as to throttle the discharge by inducing significant energy losses and to pass along items of debris, waste or recoverable material such as sticks and leaves without blockage. It will be appreciated that the dimensions of the transfer orifices may be varied to suit different sites.

The or each cell may take any suitable form and for example, may comprise a body section having a compartment therein defining the liquid retention cell. A cover or similar closure may be provided over an access opening which provides access to the liquid retention zone. In the pressurised system form of apparatus, the covers may be securely fastened to the body section enabling them to be able to withstand pressure thereagainst and further liquid and gas tight gaskets may be provided to provide a seal around the cover or closure.

In one preferred form, a group of liquid retention cells is formed from a unitary body which, for example, may be a pre-cast concrete unit with the cells being separated from one another by baffle walls having the transfer orifice therein. In that preferred form the transfer orifice is disposed adjacent the bottom wall so that liquid can flow therethrough. These units can be produced in modular form with a range of cells and orifice dimensions producing a range of incrementally variable flows. Flexible sleeves may be formed at the inlet and outlets from the unit to facilitate connection of the delivery line and discharge line. In another arrangement, there may be provided reductions in wall thickness of portions of the cell walls that can be easily broken out to facilitate connection of storage or delivery or discharge pipes. The units may be arranged in series relative to the flow direction or in some instances be disposed in parallel or as a combination of the above.

Whilst the cells may be arranged in a linear configuration it could also be possible to arrange them in various other configurations and, as discussed earlier, it would be possible to have more than one group.

Preferably the apparatus is disposed underground although this is not essential. Similarly the storage zone may also be underground. In some applications, the apparatus will be located above ground.

Preferred embodiments of the invention will hereinafter be described by way of example with reference to the accompanying drawings in which.

Figures 1, 2, 3:
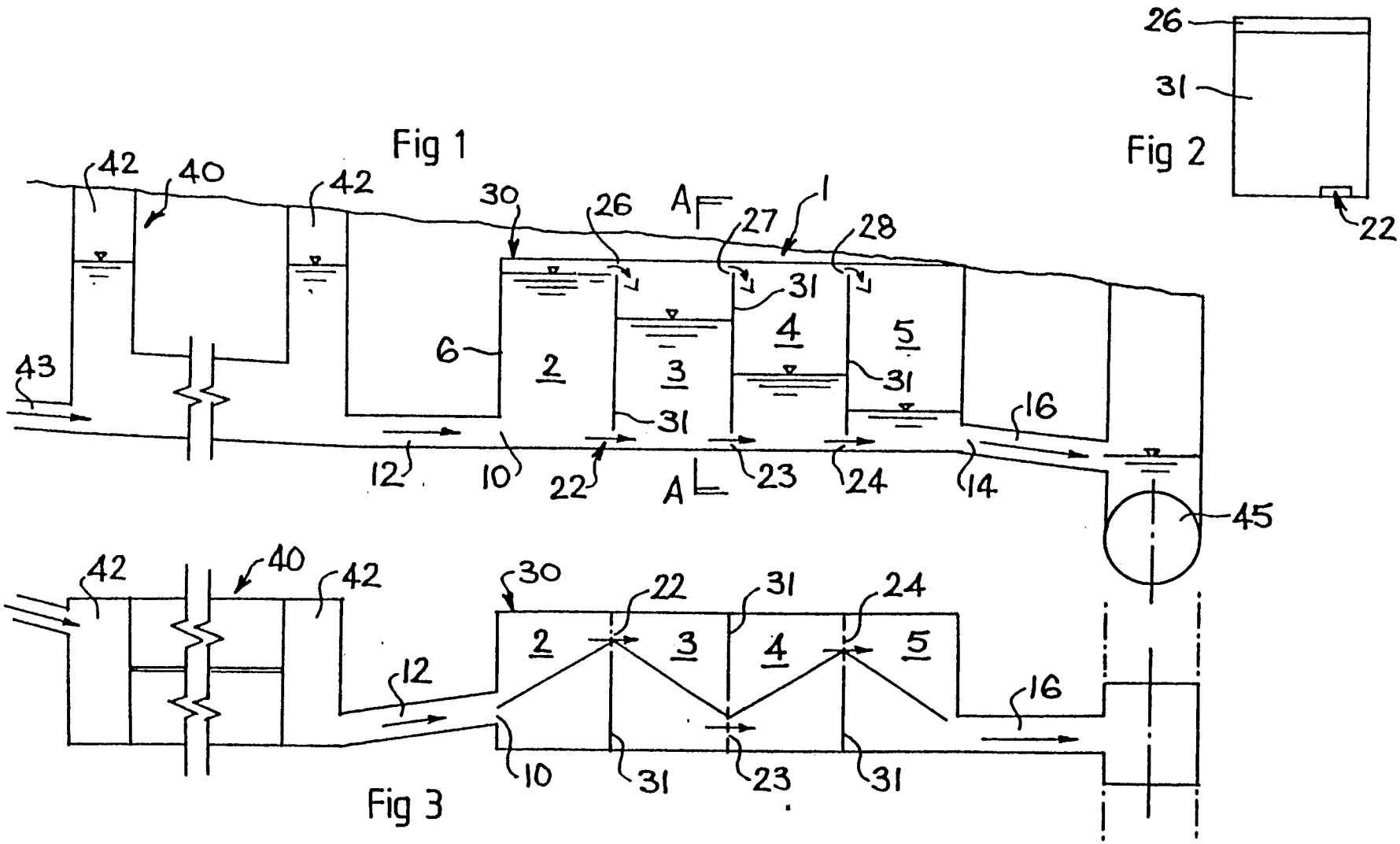
FIG. 1 is a schematic side elevation of one form of apparatus according to the present invention.
FIG. 2 is a sectional view taken along the line A—A in FIG. 1.
FIG. 3 is a plan view of the apparatus shown in FIG. 1.

The apparatus shown in the drawings will be described as applied to stormwater control but it is to be realised that the apparatus may be put to many additional uses.

Referring to the FIGS. 1 to 3 of the drawings, the apparatus shown and generally indicated at 1 is of the type known as a free surface type and comprises a plurality of liquid retention cells 2,3,4 and 5 arranged in a group 6. The group 6 of liquid retention cells have an inlet 10 thereto and an outlet 14 therefrom. The inlet is in liquid communication with an on-site storage zone 40 via delivery line 12 and the outlet is in liquid communication with main drain 45 via discharge line 16.

The on-site storage zone 40 may comprise a series of pits or storage pipes 42 which receive stormwater, for example, from the roof of a building site via feed line 43. It will be appreciated that the on-site storage can be above at or below ground level or comprise a combination of the above.

As shown, the group of retention cells is in the form of a unitary structure 30 which are separated into the various cells by means of baffle walls 31. Each of the baffle walls 31 has a transfer orifice therein and these are indicated at 22,23 and 24. Overflow weirs 26,27 and 28 are provided at the top of the baffle wall.

As best seen in FIG. 3, the transfer orifices in each of the cells are normally off-set from one another with respect to the linear direction in which they are arranged.

In practical situations, the regulated flow is typically between 3.5 and 20 liters/second with a pressure head of between 0.3 meter to 3.0 meter of liquid although the system can readily cater for flows and pressure heads beyond these values.

Figures 4, 5:
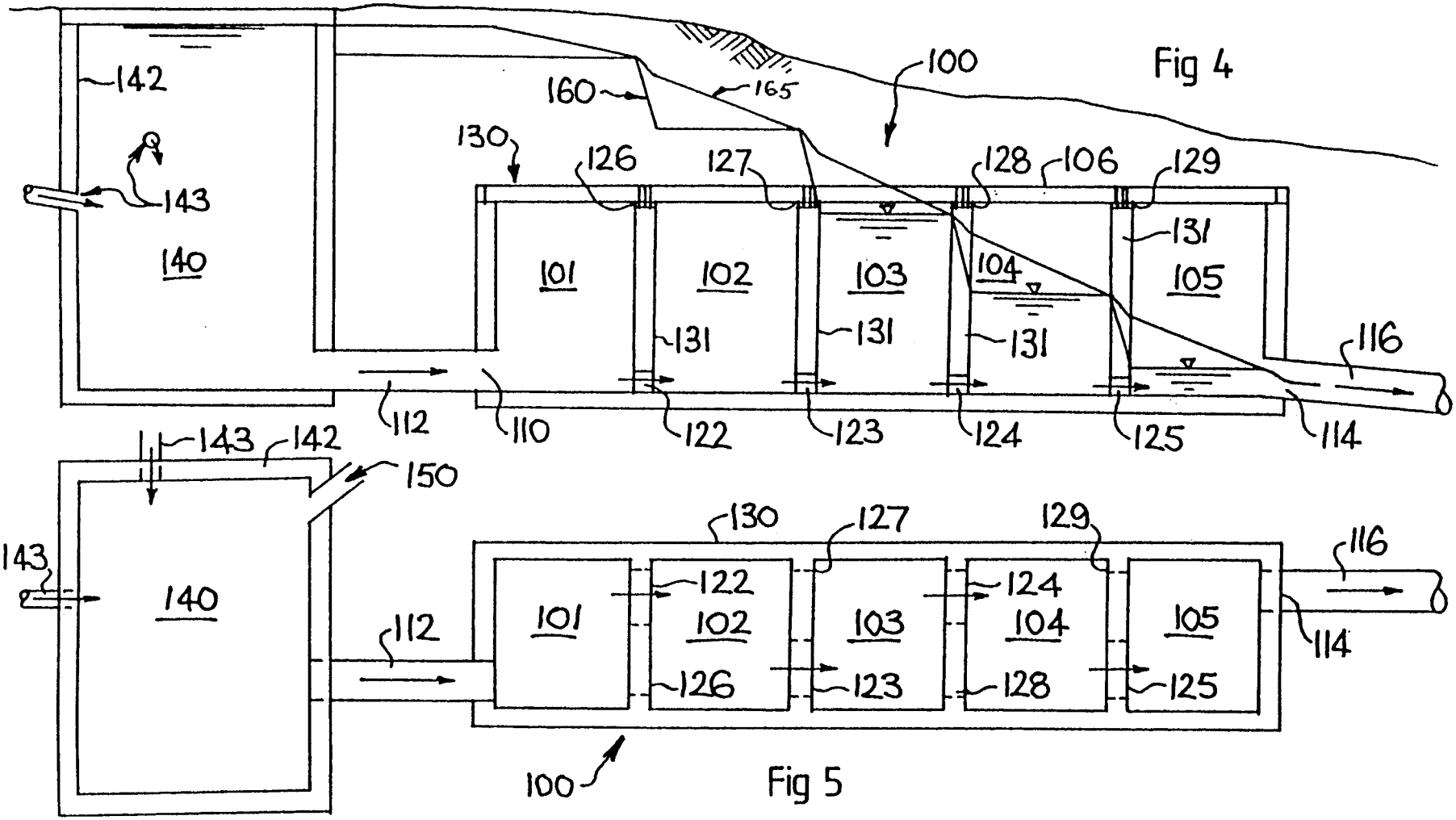
FIG. 4 is a schematic side elevation of another form of apparatus according to the present invention.
FIG. 5 is a plan view of the apparatus shown in FIG. 4.

Referring to FIGS. 4 and 5 of the drawings, the apparatus shown and generally indicated at 100 is of the type known as a pressurised system and comprises a plurality of liquid retention cells 101,102,103,104, and 105 arranged in a group 106. The group 106 of liquid retention cells have an inlet 110 thereto and an outlet 114 therefrom. The inlet is in liquid communication with an on-site storage zone 140 via delivery line 112 and the outlet is in liquid communication with main drain (not shown) via discharge line 116.

The on-site storage zone 140 comprises an enclosed pit or storage pipes 142 which can be subjected to pressure and receive stormwater, for example, from the roof of a building site via feed line inputs 143. Liquid entering the storage pit forms a pressure head therein. Provision may be provided for overflow from the storage zone via 150.

As shown the group of retention cells is in the form of a unitary structure 130 which is separated into the various cells by means of baffle walls 131. Each of the baffle walls 131 has a transfer orifice therein and these are indicated at 122,123,124 and 125. Air vents 126,127,128 and 129 are provided at the top of the baffle walls. As is the case in the earlier described system, the transfer orifices in each of the cells may be off-set from one another with respect to the linear direction in which they are arranged.

Each of the cells has a lid or cover which can be firmly secured to the other part of the cell thereby permitting the cells to be subjected to higher pressures than for example, the cells of the free surface system.

It should be noted that whilst storage zone 140 may be pressurised, there may also be provided means such as for example at 150 where provision is made for overflows of the zone. In this arrangement, the pressure will be limited by the height of the overflow.

The system shown in FIGS. 4 and 5 is adapted to operate at much higher pressures than the free surface system shown in FIGS. 1 to 3. The line 160 in FIG. 4 represents a typical hydraulic gradient line for such a system. The total energy line is indicated at 165. It can therefore be seen how energy loss occurs across the system.

The units of the system provide for a high degree of versatility in that they can be used in either direction; that is, there is no definitive upstream end or downstream end. The apparatus is relatively compact and provides for relatively precise control of the outflow from the apparatus. The configuration of the transfer orifices inhibit blockage and therefore reducing maintenance problems.

Figure 6:
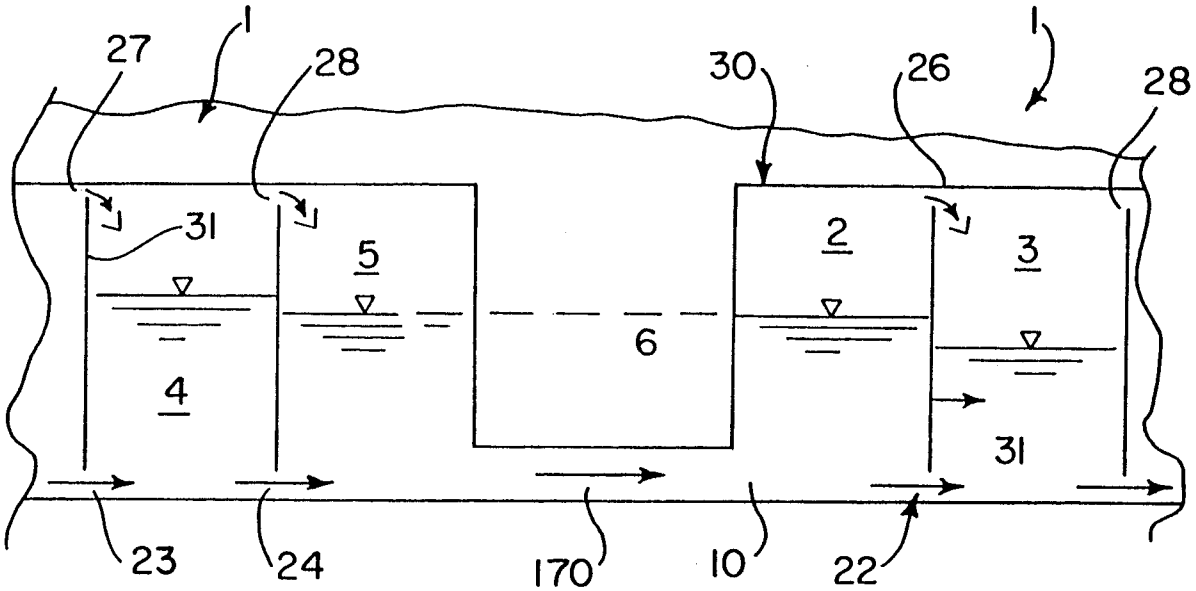
FIGS. 6 and 7 are fragmentary side and plan views, respectively, that show the inter-connection of two devices of the invention.
Figure 7:
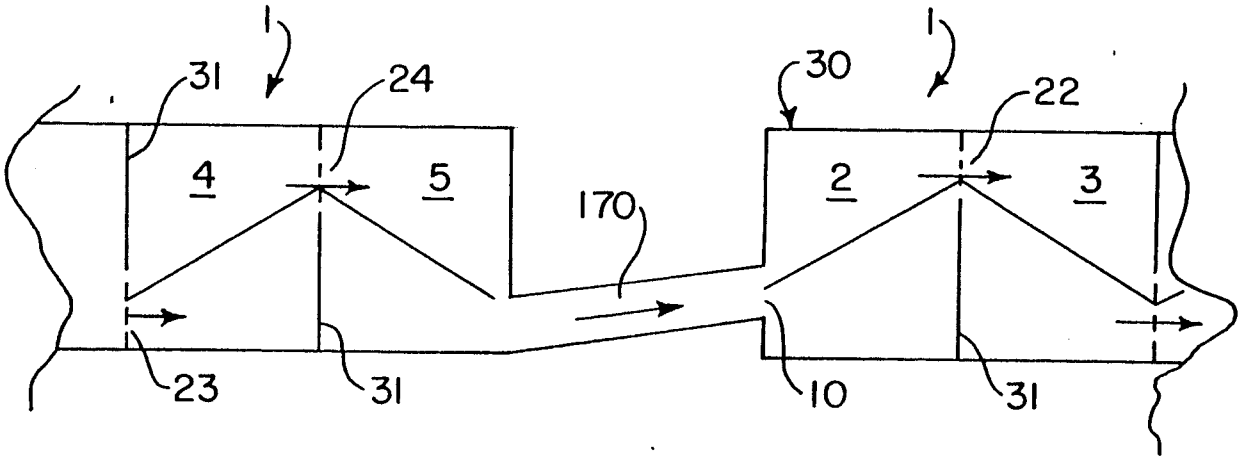

FIGS. 6 and 7 diagrammatically illustrate the use of a line 170 to interconnect two apparatuses of the invention.

Finally, it is to be understood that various alterations, modifications and or additions may be incorporated into the various constructions and arrangements of parts without departing from the spirit and ambit of the invention.

I claim:

1. Apparatus for controlling the rate of liquid discharge from a site comprising at least three liquid retention cells each having a bottom, said cells being arranged in series with respect to the flow path of the liquid through the apparatus, the liquid retention cells being arranged in at least one group which comprises at least three of said cells disposed adjacent one another, an inlet for receiving liquid previously existing at the site and for delivering liquid to an upstream cell of the apparatus and an outlet for discharging liquid from a downstream cell of the apparatus to a discharge line, and transfer orifices which provide liquid communication between adjacent cells in the group, the flow controlling structural dimension of said orifices remaining fixed during all operative states of said apparatus, the or each transfer orifice being located at the bottom of the cells and being configured so as to control the rate of liquid flow between adjacent cells and create a condition whereby there is a dissipation of energy of the liquid between each cell.

2. Apparatus according to claim 1 wherein said transfer orifices are dimensioned to permit debris to pass from one cell to the adjacent cell while at the same time causing said energy dissipation.

3. Apparatus according to claim 1 wherein the cells in the or each group are disposed one behind the other, and the transfer orifices between adjacent cells being offset from one another with respect to the general direction of flow to thereby induce rotary flows of said liquid in the cells to effect enhanced energy dissipation.

4. Apparatus according to claim 1 wherein said orifices have a length dimension greater than the height dimension thereof.

5. Apparatus according to claim 1 wherein said apparatus includes an overflow weir between adjacent cells which permits the flow of liquid over that weir.

6. Apparatus according to claim 1 including more than one group of cells.

7. Apparatus according to claim 1 wherein the apparatus has its inlet operatively connected to an on-site storage zone.

8. Apparatus according to claim 7 wherein an upstream cell forms part of said on-site storage zone.

9. Apparatus according to claim 7 wherein said inlet is operatively connected to the on-site storage zone by a delivery line.

10. Apparatus according to claim 9 wherein the delivery line is angularly inclined with respect to the inlet to the apparatus.

11. Apparatus according to claim 1 including a body section having compartments therein defining the liquid retention cells, and a cover over an access opening which provides access to the liquid retention cells.

12. Apparatus according to claim 11 wherein the cover is securely fastened to the body section enabling them to be able to withstand pressure thereagainst.

13. Apparatus according to claim 1 wherein a group of liquid retention cells is formed from a unitary body which is in the form of a pre-cast concrete unit with the cells being separated from one another by baffle walls having one of said transfer orifices therein, each transfer orifice being disposed adjacent the bottom of the baffle walls so that liquid can flow therethrough.

14. The apparatus according to claim 1 further defined as an apparatus for controlling stormwater.

15. The apparatus according to claim 1 further defined as an apparatus for controlling waste liquid.

16. Apparatus according to claim 1 wherein the bottom of each of the retention cells is at the same level.

17. A method of controlling the rate of stormwater discharge from a site to a stormwater drain of predetermined capacity, said site being capable of producing a stormwater drain-off rate in excess of said predetermined capacity, said method including the steps of:

(a) causing the stormwater to flow to a flow control apparatus having at least first, second and third cells arranged in series with transfer orifices to provide liquid communication between adjacent cells;

(b) dissipating energy in said first cell as the stormwater passes therethrough;

(c) dissipating energy in the orifice connecting the first cell to the second cell, the flow controlling structural dimensions of the orifice connecting the first and second cells remaining fixed during all operative steps of the method;

(d) dissipating energy in the second cell as the stormwater passes therethrough;

(e) dissipating energy in the orifice connecting the second cell to the third cell, the flow controlling structural dimensions of the orifice connecting the second and third cells remaining fixed during all operative steps of the method;

(f) dissipating energy in the third cell; and (g) discharging the stormwater from the third cell to said drain at a rate which does not exceed said predetermined capacity.

18. A method as claimed in claim 17 wherein including the steps of inducing the stormwater to flow in rotary paths in said first, second and third cells.

* * * * *